US006120365A

United States Patent [19]

Johnson

[11] Patent Number: 6,120,365

[45] **Date of Patent: *Sep. 19, 2000**

[54] FORMABLE SPREADER/SANDER

[76] Inventor: Bryan T. Johnson, 4310 Hillview La., Vadnais Heights, Minn. 55127

[ * ] Notice: This patent issued on a continued prosecution application filed under 37 CFR 1.53(d), and is subject to the twenty year patent term provisions of 35 U.S.C. 154(a)(2).

[21] Appl. No.: 08/612,279

[22] Filed: Mar. 7, 1996

[51] Int. Cl.[7] ..... B05C 17/10; B24D 17/00

[52] U.S. Cl. ..... 451/495; 451/524; 451/523; 451/528; 15/143.1; 15/144.1

[58] Field of Search ..... 451/495, 523, 451/524, 525, 526, 527, 530, 538, 539, 913, 528; 15/143.1, 144.1, 144.3, 245

[56] References Cited

U.S. PATENT DOCUMENTS

| | | | |
|---|---|---|---|
| 1,062,214 | 5/1913 | Bergman . | |
| 1,570,177 | 1/1926 | Pointer . | |
| 1,664,950 | 4/1928 | Sloan | 451/524 |
| 2,954,649 | 10/1960 | Carroll et al. | 451/525 |
| 2,968,057 | 1/1961 | Pratt | 15/236 |
| 3,129,540 | 4/1964 | Valles | 51/187 |
| 3,341,878 | 9/1967 | Hubbard | 15/235.4 |
| 3,676,888 | 7/1972 | Akers | 15/245 |
| 3,916,472 | 11/1975 | Carder | 15/235.6 |
| 4,097,951 | 7/1978 | Hurtt | 15/104 S |
| 4,137,670 | 2/1979 | Goralski | 451/524 |
| 4,621,465 | 11/1986 | Pangburn | 451/495 |
| 4,631,019 | 12/1986 | House | 425/458 |
| 4,751,797 | 6/1988 | Fujimori | 451/527 |
| 4,800,054 | 1/1989 | Roestenberg | 264/86 |
| 5,054,248 | 10/1991 | Thayer | 451/524 |
| 5,131,193 | 7/1992 | Demers | 51/391 |
| 5,201,785 | 4/1993 | Nagano | 451/538 |
| 5,203,123 | 4/1993 | Travis | 51/358 |
| 5,203,885 | 4/1993 | Pastre et al. | 51/298 |
| 5,351,357 | 10/1994 | Liberman | 15/245.1 |
| 5,429,545 | 7/1995 | Meyer | 451/523 |

*Primary Examiner*—Eileen P. Morgan
*Attorney, Agent, or Firm*—Dicke, Billig & Czaja, P.A.

[57] ABSTRACT

Formable spreader and/or sanding apparatus for repairing damaged automobile body lines. The apparatus includes a body having a work surface. A mechanism is coupled to the body work surface for shaping the body to conform to a desired automobile body line. A sanding member may be coupled to the body. The apparatus may further include a handle removably coupled to the body.

11 Claims, 10 Drawing Sheets

FORMABLE SPREADER/SANDER

FIELD OF THE INVENTION

The present invention is an apparatus for use in auto body repair. In particular, the present invention is a formable spreader and/or sander for quick and easy repair of difficult automotive body lines.

BACKGROUND OF THE INVENTION

Automobiles are designed with many different types of body lines. Generally, there are two main reasons body lines are implemented into automobile designs. The first reason is to add style or distinctiveness to the automobile design. Often times distinctive automobile designs or styles are achieved through a variation of complex body lines. These complex body lines include convex and concave curves, scooped areas, detailed channels, and multi-ribbed channels located within auto body panels.

Body lines are also added to automobile bodies to add strength to the sheet metal body. In recent years, automobile companies have been making an effort to reduce the weight of the vehicles as part of their engineering designs. One solution to reducing the weight of automobiles is to lighten the weight of the sheet metal used for the automobile body. In order to strengthen the light weight sheet metal, the sheet metal must be tempered, or bent in ways which strengthen the sheet metal.

In the past, automobile bodies were formed of relatively heavy weight sheet metal. The automobile body lines were very basic in shape, and usually included flat or gently curved areas. Known devices for fixing damaged automobile panels are capable for use in repairing flat or gently curved regions. One known device used for fixing damaged automobile panels is disclosed in U.S. Pat. No. 3,676,888 to Akers. Akers, U.S. Pat. No. 3,676,888 discloses an adjustable squeegee for applying "body puddy" or "body plastic" to damaged surfaces of automobile bodies having flat or gently curved regions. As shown in FIG. 1, such a device is not able to form to exact body lines or curves, and does not lend itself for use in repairing damaged automobile panels which include complex curves or intricate body lines.

SUMMARY OF THE INVENTION

The present invention is an apparatus for use in auto body repair. In particular, the present invention is a spreader and/or sander for quick and easy repair of difficult automotive body lines.

In one embodiment, the present invention includes an apparatus for repairing damaged automobile body lines. The apparatus includes a support member having a work surface. Means are coupled to the work surface for shaping the body to conform to a desired automobile body line. The apparatus may further include a sanding member coupled to the body.

In one embodiment, the body is formed of a generally flexible material. The means for shaping includes a formable member coupled to the body. In one embodiment, the formable member is a malleable member imbedded within the body. In another embodiment, the formable member is a chemical reactant responsive to a stimulus.

In another application, the present invention includes a formable spreader for repairing damaged automobile body lines. The formable spreader includes a generally rigid body having a gripping end and a spreading end. A member is coupled to the spreading end which may be formed to a desired body line shape. The member coupled to the spreading end may be responsive to a stimulus for forming the member to a desired body line shape. In one embodiment, the member includes a reactant responsive to a stimulus for shaping the member to the desired body line shape. Further, a sanding member may be coupled to the spreading member.

In yet another embodiment, the present invention includes a sanding assembly for use in sanding curved areas. The sanding assembly includes a first layer, a formable second layer is coupled to the first layer, the second layer has a shape corresponding the curved surface. A sanding member is coupled to the second layer. The sanding assembly may further include a handle coupled to the first layer. The handle may be removable.

The second layer may include a reactant responsive to a stimulus. In one embodiment, an ampule containing the stimulus is located within the second layer. The second layer may be formed of sponge material. In an alternative application, the second layer may be formed of a polymeric material. The sanding member may include hook and loop sand paper.

In another embodiment, the present invention includes a sanding assembly for use in sanding curved surfaces. The sanding assembly includes a sanding shoe. A handle assembly is removably coupled to the sanding shoe. The handle assembly may include a curved body having a first end and a second end. A fore handle is coupled to the first end. A heal member is coupled to the curved body second end.

The handle assembly may include a female member secured to the sanding shoe. A male member may be removably coupled to the female member. The sanding shoe may be formable to a desired contour shape.

The formable spreader and/or sander in accordance with the present invention allows for quick and easy repair of difficult automotive body lines.

BRIEF DESCRIPTION OF THE DRAWINGS

Other objects of the present invention and many attendant advantages of the present invention will be readily appreciated as the same becomes better understood by reference to the following detailed description when considered in connection with the accompany drawings, in which like reference numerals designate like parts throughout the figures thereof, and wherein.

DETAILED DESCRIPTION OF THE PREFERRED EMBODIMENTS

Figure 2:
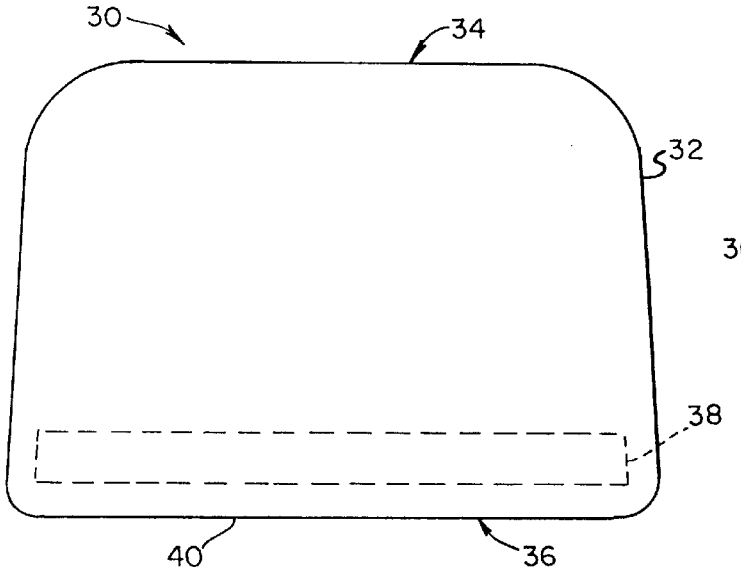
FIG. 2 is an elevational view of a formable spreader in accordance with the present invention.

FIG. 2 shows a formable spreader in accordance with the present invention generally at 30. The formable spreader 30 allows for quick and easy repair of complex automotive body lines. The formable spreader 30 includes flexible body 32. The flexible body 32 is formed of a flexible material, such as a flexible rubber or plastic.

The flexible body 32 includes a gripping end 34 and a spreading end 36. Embedded within the flexible body 32, along the spreading end 36, is shape-forming member 38. Shape-forming member 38 is formed of a formable shape retaining material and extends longitudinally adjacent edge 40 of spreading end 36. In one preferred embodiment, shape-forming member 38 is a generally rectangular shaped strip and is formed of a relatively thin, malleable, metallic material. Shape-forming member 38 may be formed of copper, aluminum, tin, lead, steel, or similar materials, or a combination or blend of these. It is also recognized that shape-forming member 38 may be formed of a formable shape-retaining, non-metallic material.

Figure 3:
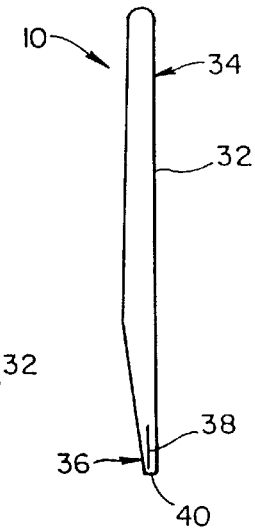
FIG. 3 is a side view of the formable spreader shown in FIG. 2.

Formable spreader 30 may be generally rectangular shaped. Referring to FIG. 3, in one embodiment, formable spreader 30 has a generally uniform thickness at its gripping end 34, with a tapered spreading end 36. Tapered spreading end 36 is relatively more flexible than gripping end 34.

Figure 4:
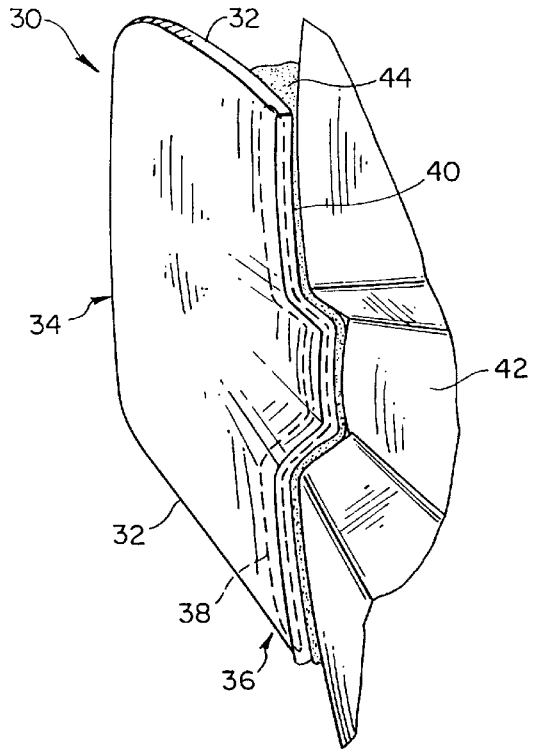
FIG. 4 is a perspective view showing the formable spreader of FIG. 2 in operation.

Referring to FIG. 4, by manually bending the spreading end 36, the formable spreader 30 will form to very sharp body lines, including convex and concave curves, scooped areas, detailed channels, and multi-ribbed channels. After shaping the formable spreading end 36 to the desired form, the shape-forming member 38 allows formable spreader 30 to retain the desired body line shape. After use, the formable spreader 30 may be straightened, and reshaped to conform to another body line for reuse.

As shown, formable spreader 30 is shaped to conform with channel 42. Since formable spreader 30 conforms to the desired channel 42 shape, it is only necessary to put down the required amount of plastic body filler 44 to repair the channel 42, saving on plastic body filler. Since less excess plastic body filler is used, formable spreader 30 also saves an enormous amount of sanding time for sanding the plastic body filler conforming to the shape of channel 42.

Figure 5:
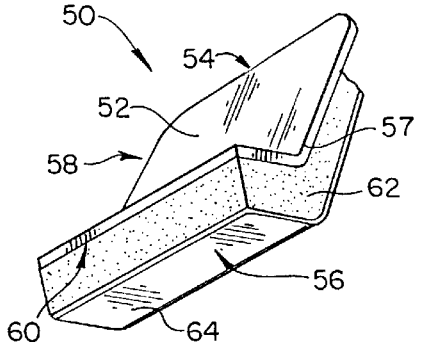
FIG. 5 is another embodiment of the formable spreader in accordance with the present invention.

Referring to FIG. 5, another embodiment of the present invention is shown generally at 50, in which the formable spreader in accordance with the present invention is a chemical formable spreader. The chemical formable spreader 50 includes a support spine 52, formed of a generally rigid material. In one preferred embodiment, the support spine 52 is formed of a clear, rigid plastic or polycarbonate. The support spine 52 includes a gripping portion 54 and a spreading portion 56 (separated by a curve region 57), a top side 58 and a bottom side 60. Secured to the bottom side 60 is formable layer 62. A flexible pad 64 may be secured to a bottom side of formable layer 62.

The chemical formable spreader 50 is formed to a desired shape or configuration by activation of a chemical process to mold formable layer 62 to a desired shape. In one embodiment, the formable layer 62 is shaped using a catilization process. In one embodiment, the formable layer 62 is very light weight and may be formed of a sponge material. Within the sponge material is a chemical reactant or hydrotropic reactant which aids in allowing the formable layer 62 to retain a desired shape. In one embodiment, the chemical reactant is glue.

The formable spreader 50 is formed to a desired body line by dipping the sponge formable layer 62 in water (which also may additionally/alternatively contain a hardening chemical, such as glue). Excess water is squeezed from the sponge, and the chemical formable spreader 50 is secured against an undamaged portion of the automobile panel having the desired body line (such as by automotive tape). The sponge formable layer 62 and flexible pad 64 take on the contour of the desired body line. The chemical formable spreader 50 (including the chemical reactant glue) is allowed to set or harden dry. Once in a hardened state, the chemical formable spreader 50 retains the desired contoured shape and is available for use in spreading plastic body filler 44 for reshaping damaged automotive body lines. Once hardened, sandpaper may also be secured to the bottom side of flexible pad 64 for using chemical formable spreader 50 as a sander.

It is also recognized that formable spreader 50 may be used without flexible pad 64.

It is also recognized that other methods may be used for forming the bottom side of chemical formable spreader 50 to a desired body line contour. In another embodiment, a polymer bag is attached to the bottom side 60, which includes a chemical reactant, and stimulant or catalyst. To obtain a desired contoured shape, the polymer bag is hit against a hard surface to start a chemical reaction. The formable spreader is then secured against an undamaged portion of the automobile having the desired body line shape. The polymer sack hardens to the desired contour of the body line for use as a spreader.

Sandpaper may be attached to the formable spreader 50 for using the formable spreader 50 as a sander. Referring to FIG. 6A, it is also recognized that small sanding blocks (shown generally at 63) may be formed to include contoured shapes for repairing/sanding damaged automobile panels, using the same methods recited above to form the desired contoured shapes. The sanding block 63 may include a gently curved support member 65 formed of rubber to aid in using block 63 as a hand sander.

Figure 7:
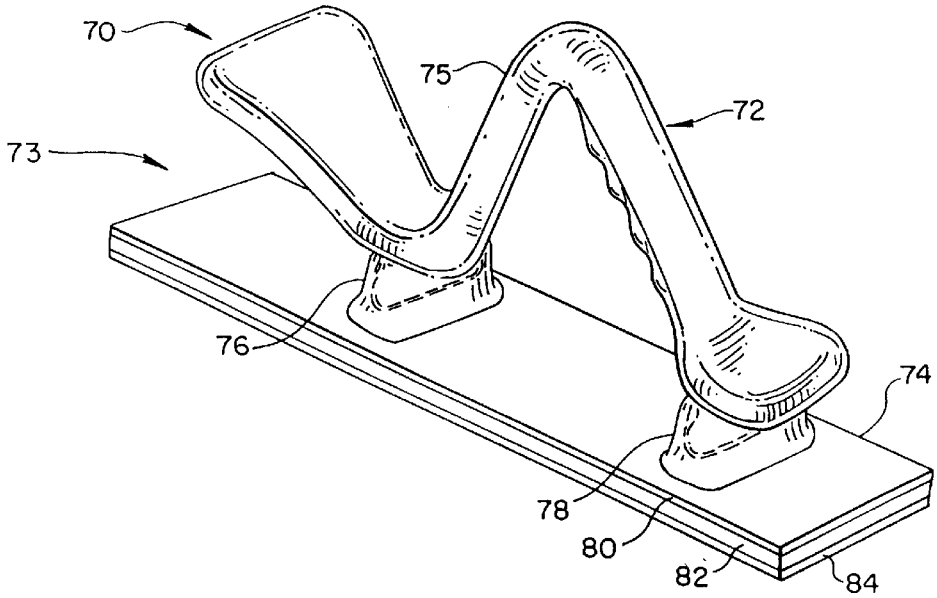
FIG. 7 is a perspective view of another embodiment of the device in accordance with the present invention.

Referring to FIG. 7, another embodiment of the present invention is shown which includes sanding assembly 70. Sanding assembly 70 includes handle assembly 72 and sanding shoe 73. Handle assembly 72 is removably coupled to sanding shoe 73.

In one embodiment, sanding shoe 73 includes a formable sanding pad 74. Handle assembly 72 includes female socket 76 and female socket 78 which are attached to the top side of sanding pad 74 for receiving handle 75. The formable sanding pad 74 generally includes a top layer 80, an intermediate layer 82, and a bottom layer 84. Female socket 76 and female socket 78 are secured to the top layer (or structural layer) 80. In one embodiment, female socket 76 and female socket 78 are secured to top layer 80 by screws or an adhesive. Sanding shoe assembly 73 will be discussed in detail later in this specification.

Figure 8:
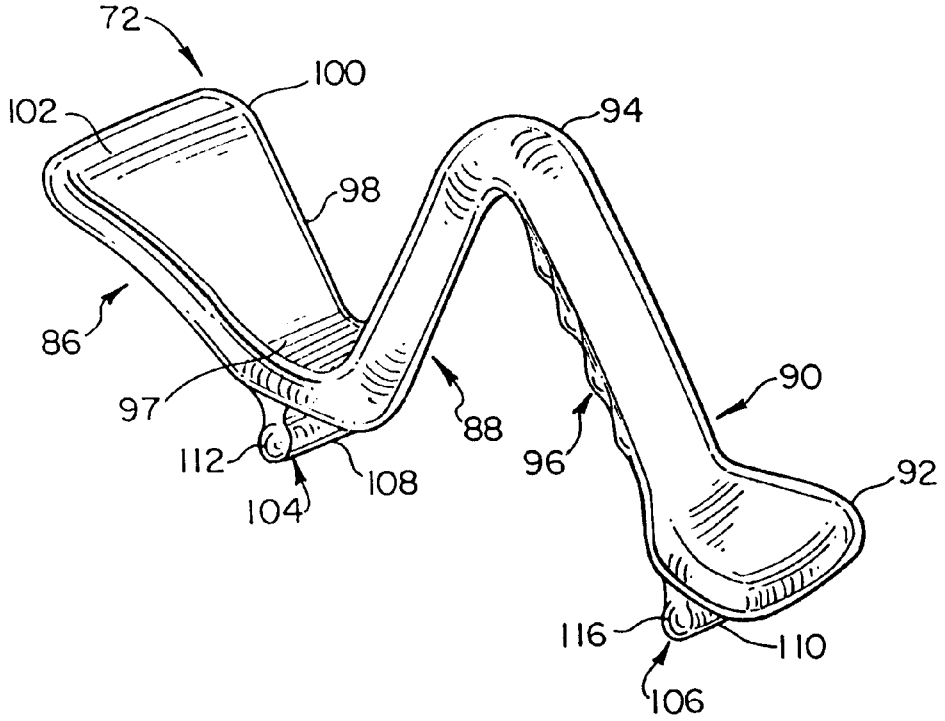
FIG. 8 is a perspective view of the handle of the device of FIG. 7.

Referring to FIG. 8, handle 72 is shown removed from sanding shoe 73. Handle 72 is generally formed of a high-strength molded plastic. Handle 72 includes fore handle 86, shank 88, and rear handle 90. Extending from rear handle 90 is heal 92. Rear handle 90 is coupled to shank 88 at hump 94. Fore handle 86 is coupled to an opposite end of shank 88. Fore handle 86 is generally flat and of a greater width than rear handle 90. Rear handle 90 extends upward from heal 92. Located on the back side of rear handle 90 is finger grip 96.

Shank 88 extends downward from rear handle 90 at hump 94. Extending upward at an opposite end of shank 88 is fore handle 86. In particular, fore handle 86 neck region 98 extends upward from the base 97 of fore handle 86 into head region 100. The width of fore handle 86 broadens through neck region 98 achieving a maximum width in head region 100. The width of fore handle 86 is generally larger than shank 88. Head region 100 includes a palm region 102, which is generally rounded for comfortable receipt of an operator's hand.

Figure 9:
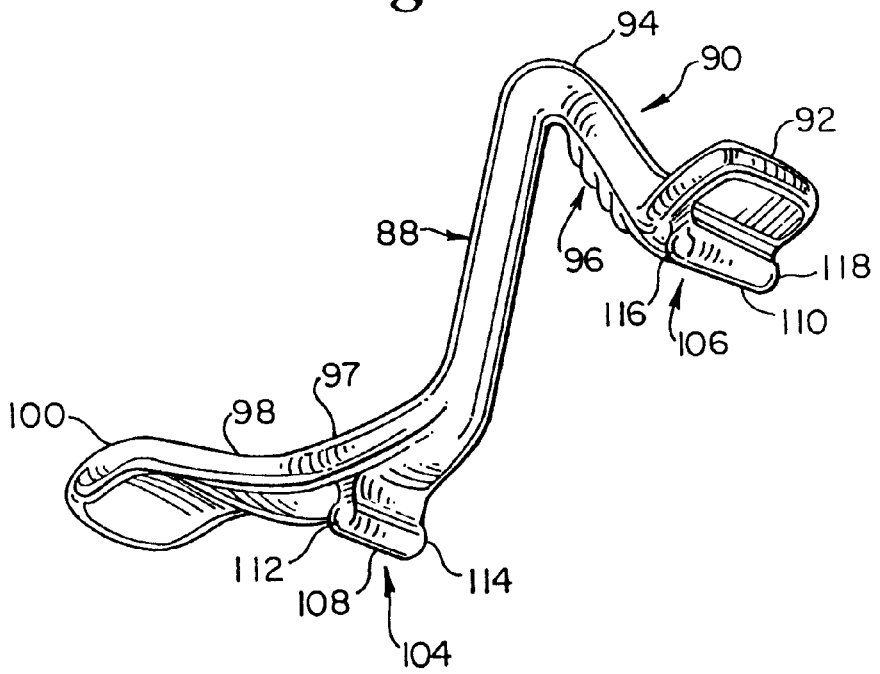
FIG. 9 is a perspective view showing the bottom, left side and rear of the handle of FIG. 7.

Referring to FIG. 9, extending outward from the bottom side of base 97 is male bar 104, and extending outward from the bottom side of heal 92 is male bar 106. Male bar 104 and male bar 106 include a generally cylindrically shaped body 108 and 110, having spherical ends 112, 114, 116 and 118.

Figure 10:
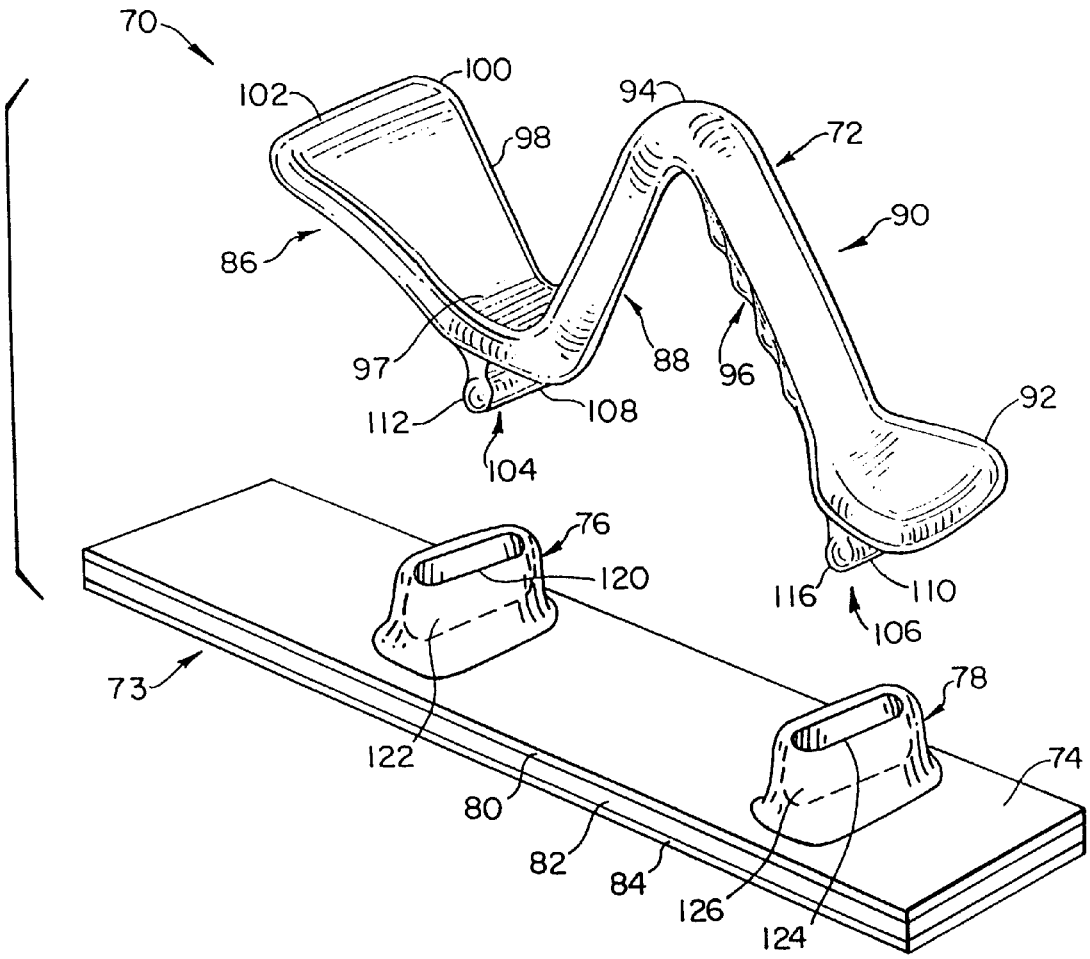
FIG. 10 is an exploded view of the device assembly of FIG. 7.

Referring to FIG. 10, an exploded view of the sanding assembly 70 is generally shown. Female socket 76 includes an opening 120 extending into a cylindrical cavity 122 for receipt of male bar 104. Similarly, female socket 78 includes an opening 124 extending into a cylindrical cavity 126. Cylindrical body 108 and spherical ends 112 and 114 form male bar 104 for slidable snap receipt into female socket 76. Similarly, cylindrical body 110, having spherical end 116 and spherical end 118, form female bar 106 for slidable snap receipt into female socket 78.

Removable handle 72 allows formable sanding pad 74 to be removed, allowing handle 72 to be used with another sanding shoe. Additionally, it is recognized that more standard configured handle assemblies may be secured to sanding shoe 73, such as a standard U-shaped handle with a knob at one end.

In one preferred embodiment, handle 72 is formed of a high-density, polyethylene. Handle 72 is flexible, light weight, and has a high resistance to harmful or corrosive chemicals. The handle 72 is gently curved and rounded, allowing an operator's hand to comfortably grasp the handle. The handle 72 is designed for use by both right handed and left handed operators.

Heal 92 includes a gently cupped shaped area for the heal of an operator's hand to rest during operation of the sanding assembly 70. Head region 100 includes palm region 102, having a wide area for an operator's palm to rest during operation of the sanding assembly 70.

Conventional sanders include a round knob at the head of the sander for an operator to grip during a sanding operation. In contrast with the present invention, the wide palm region 102 leaves the hand in a more open position during operation of the sanding assembly, allowing the technician to feel the surface imperfections through the handle while performing a sanding operation. The front end of head region 100 is gently rolled, further allowing an operator to easily grip the sanding assembly 70.

The unique design of handle 72 allows force or pressure to be efficiently transferred to the work surface using various operator sanding positions. The leveraged design of handle 72 allows maximum force to be transferred to the work surface, while allowing maximum comfort for the operator.

The size and shape of male bar 104 matches the size and shape of male bar 106. Correspondingly, the size and shape of female socket 76 matches the size and shape of female socket 78. This interchangeability allows the handle 72 to be mounted in either direction on sanding shoe 73. Since spherical end 114 and spherical end 116 are gently rounded corresponding to cylindrical cavity 122 and cylindrical cavity 126, when handle 72 is snap-fit to sanding shoe 73, handle 72 may be operably rotated about sanding shoe 73 to aid in sanding curved regions.

Referring to sanding shoe 73 formable sanding pad 74, top layer 80 is formed of a rigid material. In one embodiment, top layer 80 is formed of a generally rigid, clear, polycarbonate plastic. The degree of flexibility of top layer 80 may vary. Secured between top layer 80 and bottom layer 84 is intermediate layer 82. The intermediate layer 82 is formed of a formable material. In one embodiment, intermediate layer 82 is formed of sponge. Bottom layer 84 is secured to intermediate layer 82 by an adhesive. Bottom layer 84 is relatively more flexible than top layer 80, and in one embodiment is formed of a flexible plastic or rubber material.

Figure 11:
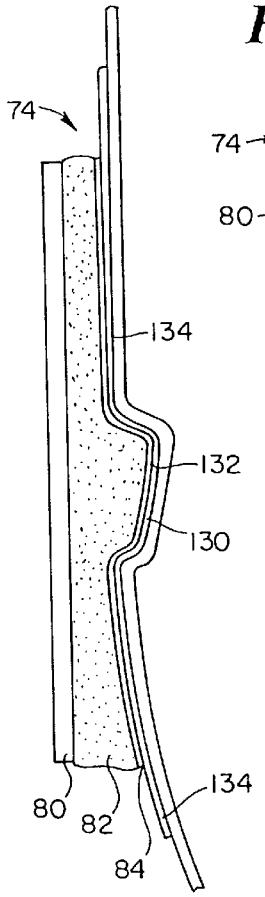
FIG. 11 is a side view of another embodiment of the present invention constrained to a panel having a complex curve.

Referring to FIG. 11, the formable sanding pad 74 may be formed to take on a desired shape corresponding to the desired body line. Contained within the intermediate layer 82 sponge material is a chemical reactant or hydrotropic reactant which aids in allowing formable sanding pad 74 to retain a desired shape. In one embodiment, the reactant is glue.

The formable sanding pad 74 is formed to a desired body line by dipping the formable sanding pad 74 in water. It is recognized that as an alternative to intermediate layer 82 containing a chemical (or hydrotropic) reactant such as glue, the water itself may contain a chemical agent, such as glue, for allowing formable sanding pad 74 to harden and retain its shape. Excess water is squeezed from intermediate layer 82, and the formable sanding pad 74 is secured against an undamaged portion of the automobile panel having the desired body line (such as by automotive tape). The intermediate layer 82 and bottom layer 84 take on the contour of the desired body line. The formable sanding pad 74 is allowed to set or harden. Once in a hardened state, the formable sanding pad 74 retains the desired contoured shape for use in sanding plastic filler for reshaping damaged automotive body lines.

Once formable sanding pad 74 is in a hardened state, sandpaper may be secured to the bottom side of bottom layer 84. The sandpaper 130 is secured to bottom layer 84 along contoured area 132. In one known method, protective tape 134 is secured adjacent the contoured area which is being repaired, to protect undamaged portions of the automotive body from the repair process. Sandpaper 130 may be secured to bottom layer 84 using an adhesive, or alternatively, sandpaper 130 may be secured to bottom layer 84 by other methods, such as the use of hook and loop sandpaper (described later in this application).

Figure 12:
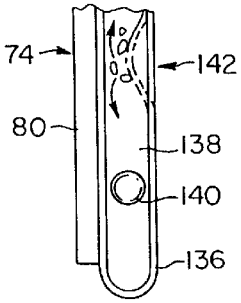
FIG. 12 is a partial detailed view of another embodiment of the base of the device in accordance with the present invention.

Referring to FIG. 12, it is recognized that alternative methods may be used for conforming formable sanding pad 74 to a desired body line within the scope of the present invention. In this embodiment, a chemical sack 136 is secured to top layer 80. Chemical sack 136 includes a chemical reactant, such as a resin polymer. Additionally located within chemical sack 136 are ampules 140. Ampules 140 contain a catalyst which reacts with chemical 138.

To form formable sanding pad 74 to a desired contour, chemical sack 136 is hit against a hard surface to break open ampules 140, indicated at 142. On breaking open, ampules 140 release a stimulus into chemical sack 136 to start a chemical reaction with chemical 138. Formable sanding pad 74 now may be secured to a desired automotive contoured surface. The ampule 140 catalyst mixes with chemical reactant 138 to form a substance which hardens to a desired body line contour. As previously described herein, sandpaper may now be secured to the contoured area of formable sanding pad 74 for sanding very intricate and complex contoured automotive body panels.

Figure 13:
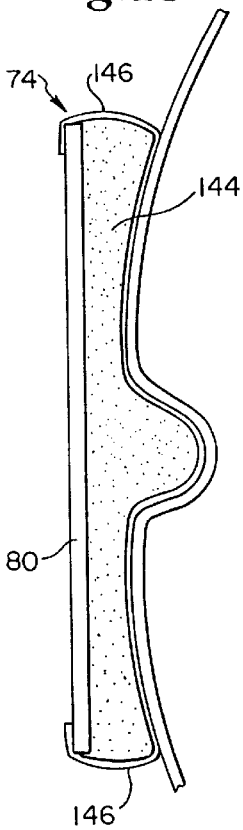
FIG. 13 is a side view of another embodiment of the base of the device in accordance with the present invention.
Figure 14:
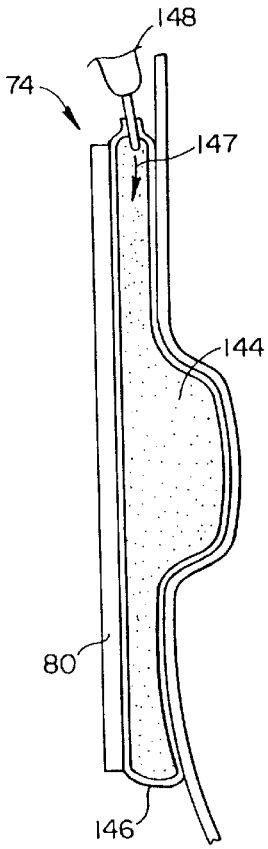
FIG. 14 is a side view of another embodiment of the base of the device in accordance with the present invention.

Referring to FIG. 13, yet another application of forming the formable sanding pad 74 to a desired contoured shape in accordance with the present invention is shown. An envelope 146 is secured to top layer 80. Contained within envelope 146 is a binary slurry 144. Binary slurry 144 is in a first generally soft, formable state. When formable sanding pad 74 is secured to an automotive panel, envelope 146 containing binary slurry 144 takes on a desired contour body line shape. Referring to FIG. 14, binary slurry 144 is hardened by injecting a chemical catalyst (indicated by binary injector 148) into the binary slurry causing the binary slurry 144 to harden to the desired automobile panel contoured shape.

It is recognized that an alternative substance may be injected into envelope 146 and harden to a desired contour shape. In one application, a two-part foam is injected into envelope 146. The two part foam quickly hardens to the desired contoured shape. After hardening, sandpaper may be secured to the contoured area for sanding complex automotive body lines.

Figure 15:
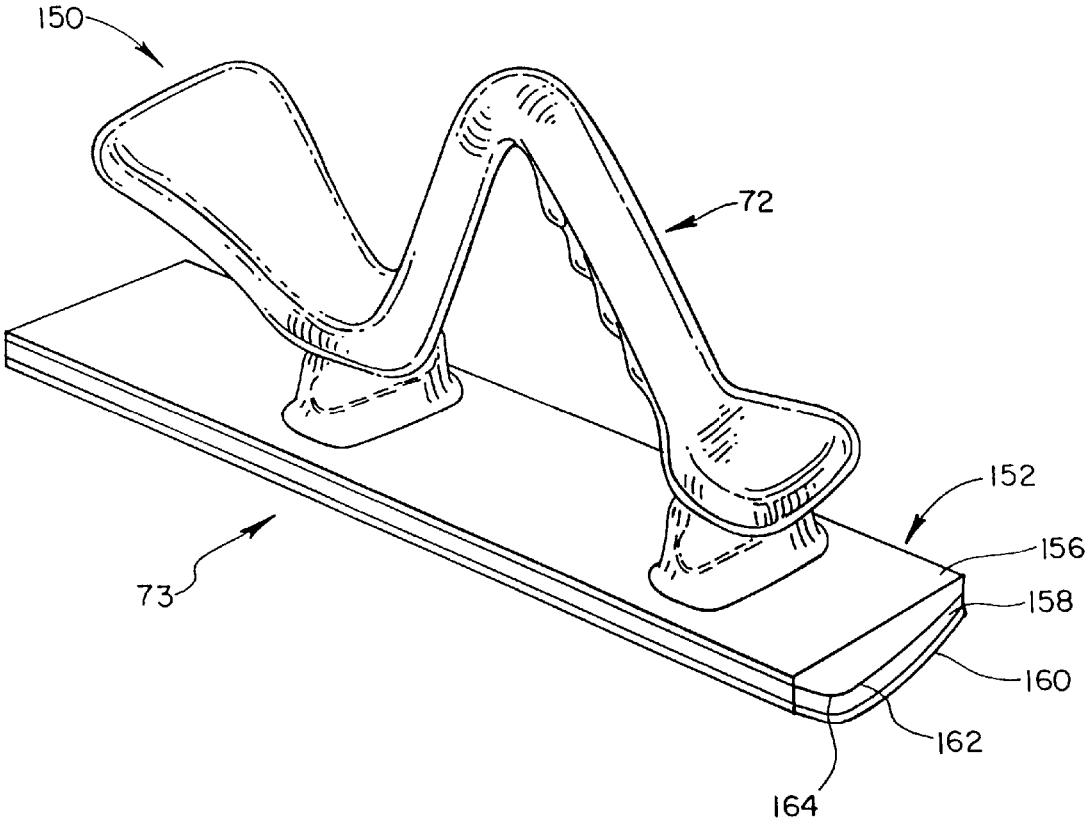
FIG. 15 is a perspective view of one application of the device in accordance with the present invention.

It is recognized that sanding shoe 73 is removably coupled to handle 72, and may be changed out to other sanding shoe designs. Referring to FIG. 15, sanding assembly 70 is generally shown, showing another application in accordance with the present invention. Sanding assembly 70 includes handle 72 removably coupled to curved sanding pad 152. Curved sanding pad 152 can be similar to formable sanding pad 74 as previously described herein. Curved sanding pad 152 is a sanding shoe which may be used with handle 72 for sanding repair of relatively sharper curved or concave surfaces.

In one preferred embodiment, curved sanding pad 152 generally includes a relatively stiff pad 156, an intermediate layer 158, and sandpaper layer 160. Relatively stiff pad 156 is formed of a relatively stiff material, such as a molded polycarbonate. The relatively stiff pad 156 is formed to include a curved region along its bottom surface 162. Intermediate layer 158 is generally uniform in width and secured to the bottom surface 162 of pad 156. Intermediate layer 158 is formed of a relatively softer material, such as foam or rubber, and conforms to the shape of pad 156.

Secured to intermediate layer 158 is sandpaper layer 160. Sandpaper layer 160 may be secured to intermediate layer 158 using an adhesive. In the embodiment shown, curved sanding pad 152 includes a curved portion 164 which tapers gently to the edge of the pad 156. With this type of curve, the sanding assembly 150 is designed for sanding repair of relatively sharper concave body lines. Since the curved sanding pad 152 has the ability to flex, the sandpaper layer 160 is able to maintain full or maximum work surface contact during sanding of the sharp concave body line.

Figure 16:
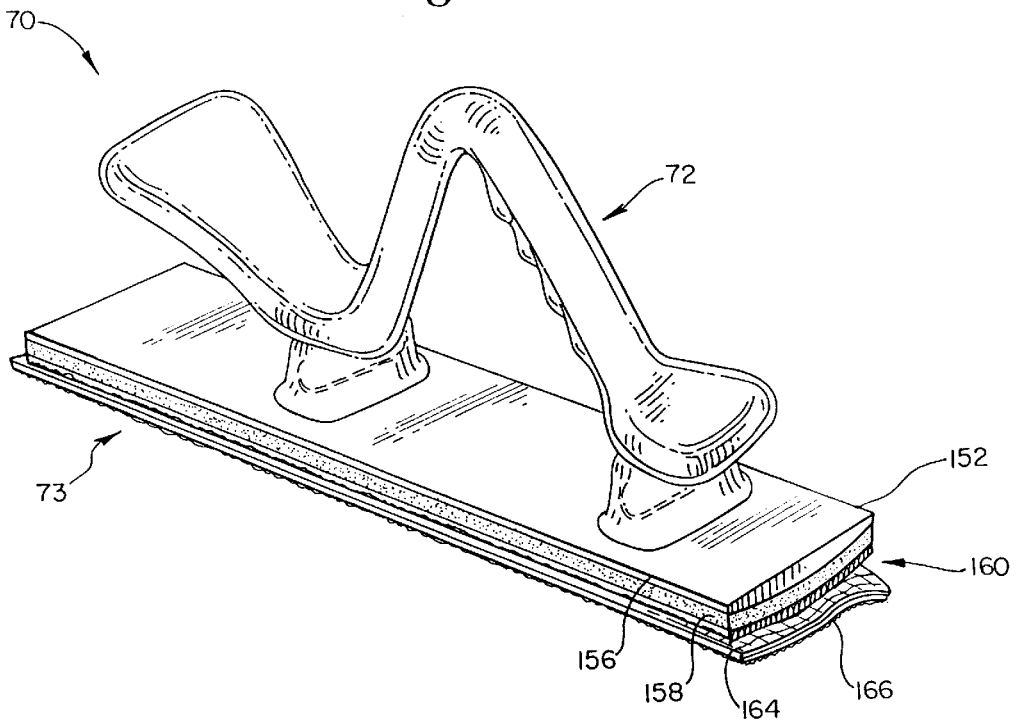
FIG. 16 is another application of the formable spreader/sander device in accordance with the present invention.

Referring to FIG. 16, another application of the curved sanding pad 152 in accordance with the present invention is shown. In this application, the sandpaper layer 160 is a hook and loop type sandpaper. The hook and loop type sandpaper allows sanding shoe 73 to be changed out to a new piece of sandpaper after use. In one embodiment, the hook and loop sandpaper is Hookit Regalite™ sandpaper, as manufactured by 3M Company.

In this embodiment, sandpaper layer 160 includes looped base 164 which is secured to intermediate layer 158 by an adhesive. Changeable sandpaper 166 may be removably secured to hook base 164. If it is necessary to change out sandpaper, the changeable sandpaper 166 is removed from hook base 164 and replaced, allowing sanding assembly 150 to be reused.

Figure 17:
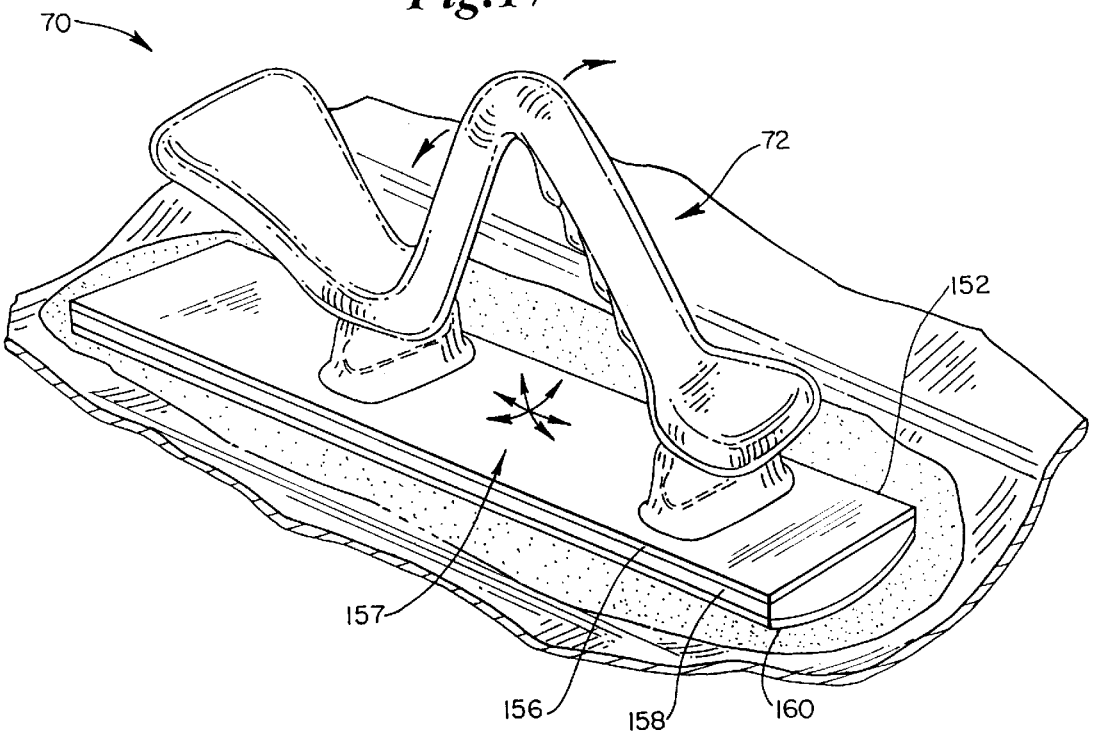
FIG. 17 is another application of the formable spreader/sander in accordance with the present invention.

In the embodiment shown, pad 156 is gently curved for the sanding repair of very large concave automotive surfaces. Referring to FIG. 17, the curved sanding assembly 150 allows more sandpaper to make contact with the surface being repaired. This allows a shorter sanding time and a more uniform sanding job. Since pad 156 is somewhat flexible, sanding assembly 150 adapts to the concave surface being sanded. As indicated by directional arrows 157, sanding assembly 70 allows a universal range of motion for sanding in every direction.

Additionally, hook and loop sandpaper works well with sanding shoe 73, including curved sanding pad 152. The hook and loop sandpaper easily flexes with the curved surface, and is not susceptible to tearing like a more rigid sandpaper. Additionally, the looped sandpaper 166 may be changed out, allowing sanding shoe 73 to be reused.

Figure 18:
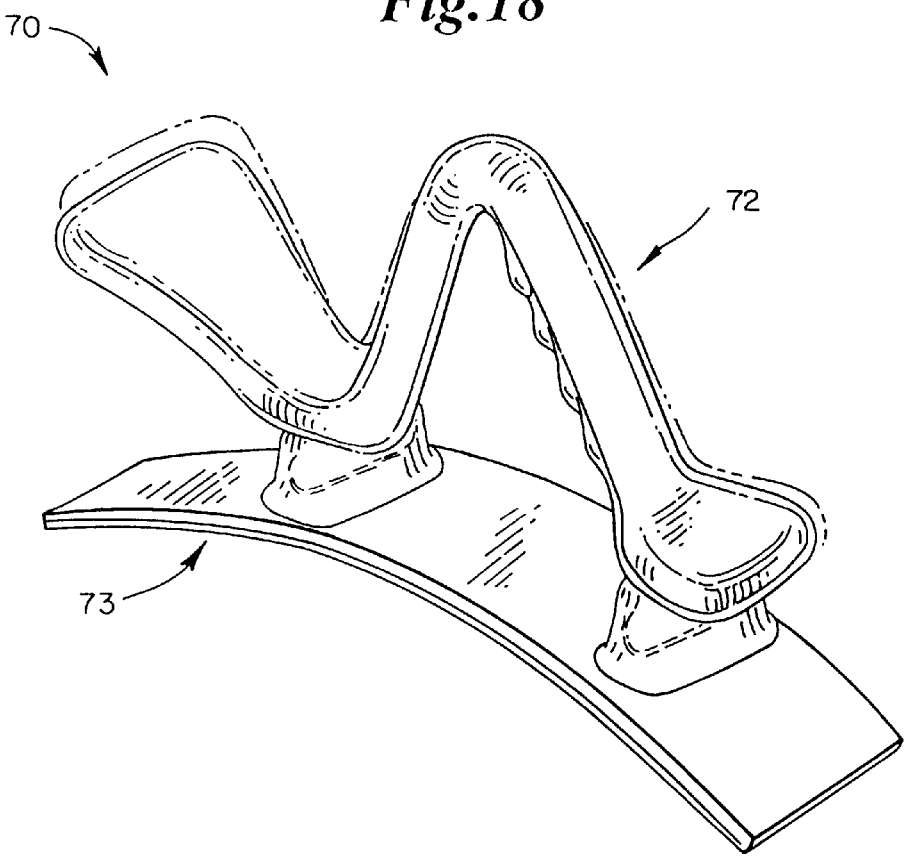
FIG. 18 is another application of the formable spreader/sander device in accordance with the present invention.
Figure 19:
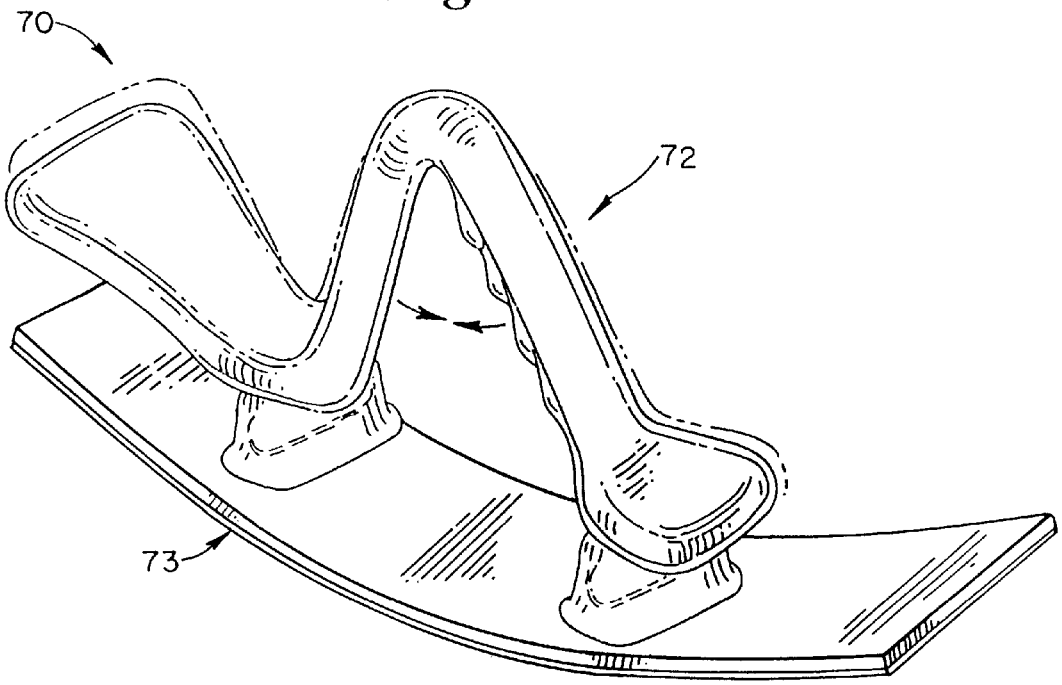
FIG. 19 is another application of the formable spreader/sander in accordance with the present invention.

Referring to FIG. 19, another application of sanding assembly 70 in accordance with the present invention is shown. In this embodiment, sanding shoe 73 is a relatively flexible member. In one application, sanding shoe 73 is formed of a flexible polycarbonate. By applying pressure to handle 72, sanding assembly 70 may be used to sand generally convex surfaces. Referring to FIG. 18, by applying pressure to the novel handle 72, sanding assembly 70 may be used for sanding of concave surface. Handle 72 flexes with sanding shoe 73, maintaining maximum contact with the sanding surface.

The formable spreader 30 and sanding pad assembly in accordance with the present invention allows automotive technicians to repair the most difficult automotive body lines with relative ease. Past automotive body panels which would have required replacement may now be easily repaired using the present invention.

Figure 20:
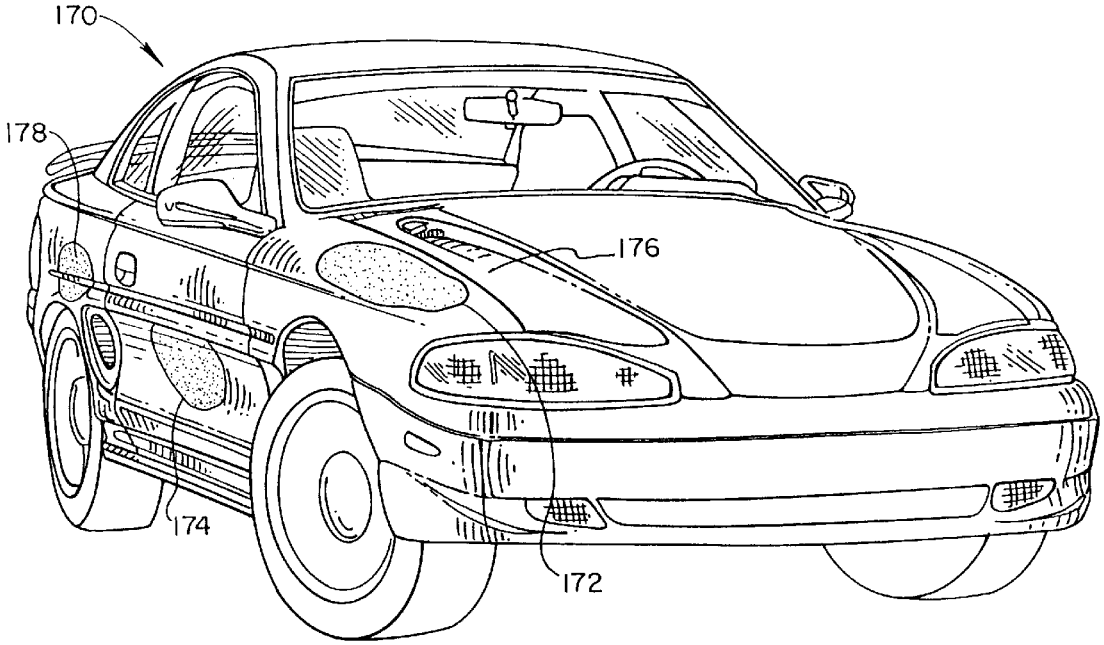
FIG. 20 is a perspective view of an automobile having various areas for repair using the device in accordance with the present invention.

Referring to FIG. 20, an automobile is generally shown at 170 having different styles of automotive body lines, including convex surfaces 172, concave surfaces 174, scoop details 176, channel details 178, etc. Each of these different body lines may be repaired using the spreader/sander in accordance with the present invention. In repairing an automotive body, it is common practice for a technician to first hammer, pull, or otherwise reshape the damaged area to the approximate original shape. A grinder is used to grind the paint off in the damaged area to be repaired.

To return the automotive body damaged area to its original contour, self-curing synthetic plastic body filler is spread over the flat or gently contoured damaged areas. To complete this process, the formable spreader and formable sanding pad in accordance with the present invention are preformed to match the desired body line or shape of the area having complex body lines.

Figure 1:
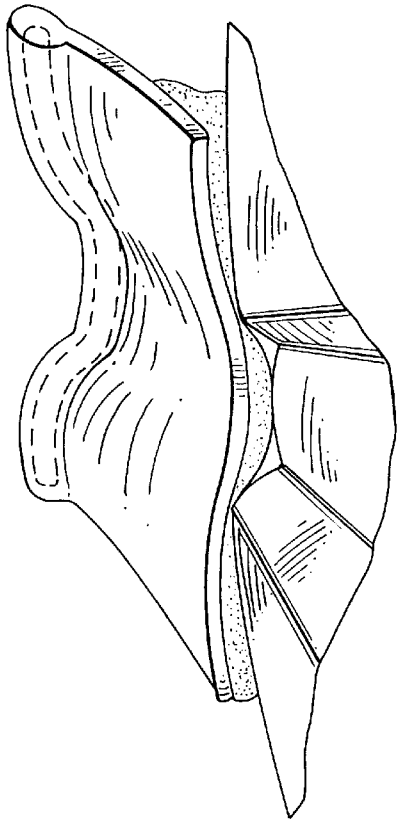
Fig.1 PRIOR ART
FIG. 1 is a detailed view showing a prior art device for fixing damaged automobile panels.

If the formable spreader 30 shown in FIG. 1 is used, spreading end 36 is manually formed to correspond to the desired body line. If a chemical formable spreader 50 is used, a formable pad as previously described herein is shaped to the desired body line or contour. For example, if the chemical formable spreader 50 of FIG. 5 is used, the chemical spreader 50 is dipped into water to start the catalization process. Excess water is squeezed from the formable spreader sponge 62, and the chemical formable spreader 50 is compressed onto the desired body line. The chemical formable spreader 50 may be taped across the desired body line until the formable spreader 50 sets and hardens. At the same time, by methods previously described herein, the formable sanding assembly 70 may be prepared to the desired contour shape.

Figure 6:
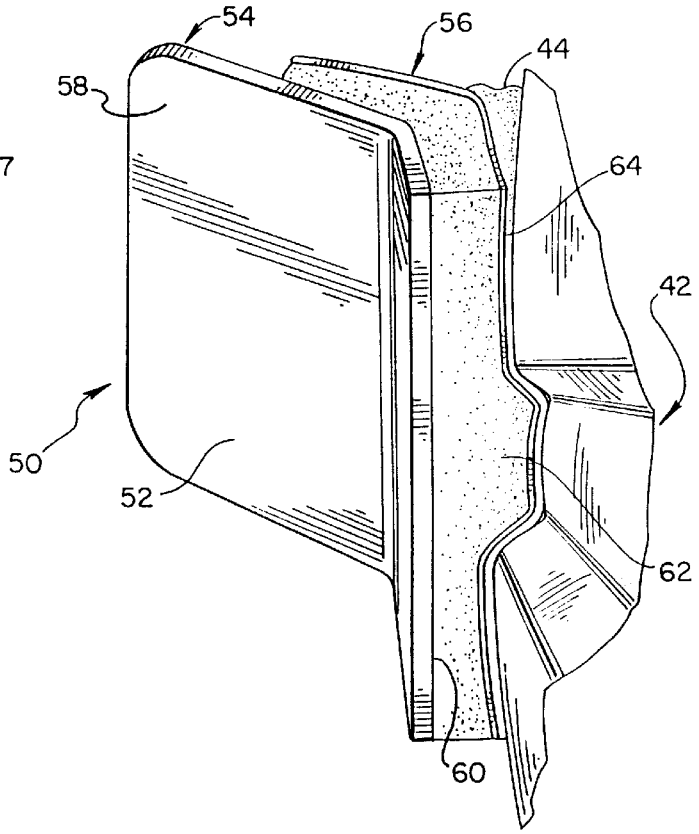
FIG. 6 is a perspective view of the formable spreader of FIG. 5.
Figure 6A:
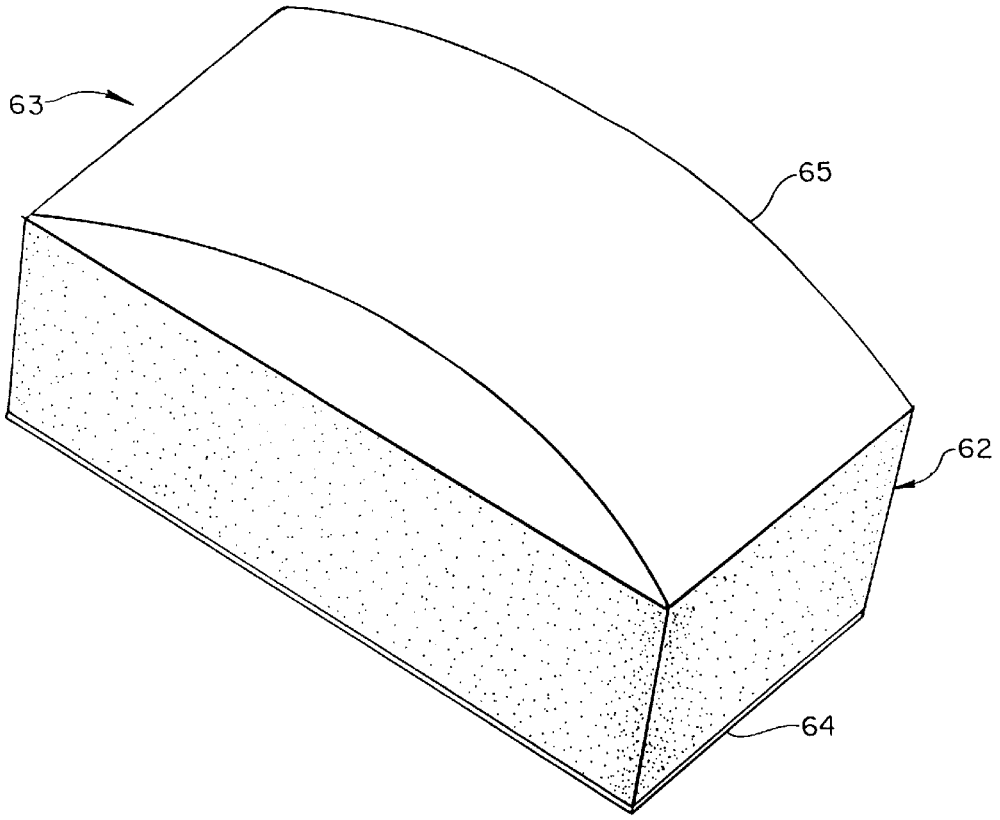
FIG. 6A is a perspective view of another application of the device in accordance with the present invention.

Referring to FIGS. 4 and 6, the automotive technician spreads the synthetic plastic filler within the damaged contoured area, matching the approximate body line shape by using the formable spreader in accordance with the present invention. After the plastic filler is hardened and dries, the damaged contoured area may be finish sanded to its original contour shape.

An automotive sealer paint is sprayed on the areas surrounding the damaged contour for adhesion of protective automotive tape. Protective automotive tape is then put on the areas surrounding the damaged area such that they will not be damaged while repairs are being made.

At this time, an additional small amount of plastic filler is put into the contoured areas using the formable spreader (for example, as shown in FIG. 4 and FIG. 6).

After the plastic body filler is allowed to dry, the sanding assembly 70 may be used for sanding the contoured area. For sanding the contoured area, adhesive backed sandpaper may be secured to the formable sanding pad 74. It is desirable that the sandpaper only be attached to the part of the sanding pad which will be sanding the damaged body lines. Alternatively, hook and loop sandpaper may be used. The desired sanding shoe 73 (including previously shaped formable sanding pad 74) is snapped into handle 72 for sanding the damaged area. Once sanding is completed, the damaged automotive body is ready for painting. The formable sanding pad in accordance with the present invention may also be used for sanding the primer for assurance of a finished paint job.

It will be understood that this disclosure is, in many respects, only illustrative. Changes may be made in details, particularly in matters of shape, size, material, and arrangement of parts, without exceeding the scope of the invention. Accordingly, the scope of the invention is as defined in the language of the appended claims.

What is claimed is:

1. A formable spreader for repairing damaged automobile body lines, the formable spreader comprising:

a body member formed of a generally flexible material, the body member having a gripping end and a spreading end; and a mechanism coupled to the spreading end for forming the body member to a desired shape, wherein the mechanism includes a formable, shape retaining member embedded in the spreading end, and wherein the shape retaining member is not embedded within the gripping end, and further wherein the body is generally rectangular shaped and the spreading end includes a spreading edge, and wherein the shape retaining member extends longitudinally adjacent the spreading edge.

2. The formable spreader of claim 1, wherein the shape retaining member is a thin, malleable metallic material.

3. The formable spreader of claim 1, wherein the spreading end is thinner than the gripping end.

4. The formable spreader of claim 3, wherein the spreading end is tapered to the spreading edge.

5. The formable spreader of claim 1, wherein the spreading end includes a working surface, and wherein the spreading end has a generally flexible sandpaper sheet attached to the working surface, wherein the generally flexible sandpaper sheet conforms to the shape of the shape retaining member.

6. A formable spreader as recited in claim 3 wherein the spreader has a width and the spreading end has a thickness and the ratio of width to thickness is greater than about 20 to 1.

7. A formable spreader as recited in claim 6 wherein the ratio is greater than about 30 to 1.

8. A formable spreader as recited in claim 1 wherein the generally flexible material is selected from the group consisting of rubber and plastic.

9. A formable spreader as recited in claim 4 wherein the spreader has a width and the spreader edge has a thickness and the ratio of width to thickness is greater than about 20 to 1.

10. A formable spreader as recited in claim 9 wherein the ratio is greater than about 30 to 1.

11. A formable spreader for repairing damaged automobile body lines, the formable spreader comprising:

a body member formed of a generally flexible material, the body member having a gripping end and a spreading end; and a mechanism coupled to the spreading end for forming the body member to a desired shape, wherein the mechanism includes a formable, shape retaining member embedded in the spreading end, and wherein the shape retaining member is not embedded within the gripping end, and further wherein the spreading end includes a spreading edge, and wherein the shape retaining member extends longitudinally adjacent the spreading edge, wherein the shape retaining member is a thin, malleable metallic material, and wherein the spreading end is thinner than the gripping end.

* * * * *